US006540560B1

(12) United States Patent
Ito et al.

(10) Patent No.: US 6,540,560 B1
(45) Date of Patent: Apr. 1, 2003

(54) CARD CONNECTOR

(75) Inventors: Toshiyasu Ito, Chiba (JP); Takahiro Sakamoto, Osaka (JP)

(73) Assignees: Yamaichi Electronics Co., Ltd., Tokyo (JP); Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/703,682

(22) Filed: Nov. 2, 2000

(30) Foreign Application Priority Data

Nov. 5, 1999 (JP) ..... 11-316108

(51) Int. Cl.[7] ..... H01R 24/00
(52) U.S. Cl. ..... 439/633; 439/64
(58) Field of Search ..... 439/630, 632, 439/633 I, 64, 946, 235, 441

(56) References Cited

U.S. PATENT DOCUMENTS

| | | | | |
|---|---|---|---|---|
| 3,823,367 A | | 7/1974 | Kaye et al. | |
| 3,932,016 A | | 1/1976 | Annenheuser | 439/377 |
| 4,780,603 A | | 10/1988 | Hamada | |
| 4,864,116 A | | 9/1989 | Banjo et al. | 235/492 |
| 5,036,430 A | | 7/1991 | Hills | |
| 5,198,645 A | | 3/1993 | Martin et al. | 235/441 |
| 5,207,598 A | | 5/1993 | Yamada et al. | 439/636 |
| 5,320,552 A | * | 6/1994 | Reichardt et al. | 439/331 |
| 5,374,198 A | | 12/1994 | Nagata | 439/636 |
| 5,511,986 A | * | 4/1996 | Casey et al. | 439/188 |
| 5,581,127 A | * | 12/1996 | Shinohara | 257/679 |
| 5,668,365 A | | 9/1997 | Ito et al. | 235/486 |
| 5,718,609 A | * | 2/1998 | Braun et al. | 439/630 |
| 5,872,353 A | | 2/1999 | Reichardt et al. | 235/441 |
| 6,068,500 A | * | 5/2000 | Kantner | 439/218 |
| 6,089,919 A | | 7/2000 | Nishioka | 439/630 |
| 6,126,486 A | * | 10/2000 | Chang | 439/630 |
| 6,129,571 A | * | 10/2000 | Ikemoto | 439/260 |
| 6,213,785 B1 | * | 4/2001 | Nishio et al. | 439/64 |
| 6,234,845 B1 | * | 5/2001 | Hakozaki | 439/633 |

FOREIGN PATENT DOCUMENTS

| | | |
|---|---|---|
| EP | 0 284 431 A2 | 9/1988 |
| JP | 63-133473 | 6/1988 |
| JP | 1-168978 | 11/1989 |
| JP | 2-187887 | 7/1990 |
| JP | 05-502746 | 5/1993 |
| JP | 06-044052 | 2/1994 |
| JP | 06-162284 | 6/1994 |
| JP | 07-153524 | 6/1995 |
| JP | 07-335321 | 12/1995 |
| JP | 08-315084 | 11/1996 |
| JP | 09-7694 | 1/1997 |
| JP | 10-91729 | 4/1998 |
| JP | 10-240871 | 9/1998 |
| JP | 11-053503 | 2/1999 |
| JP | 2000-277200 | 10/2000 |

OTHER PUBLICATIONS

International Search Report dated Feb. 6, 2001 from the European Patent Office.

(List continued on next page.)

*Primary Examiner*—Tulsidas Patel
(74) *Attorney, Agent, or Firm*—Finnegan, Henderson, Farabow, Garrett & Dunner LLP

(57) ABSTRACT

The connector body comprises: side portions to guide side surfaces of the inserted IC card; a bottom portion having a support surface to support a back surface or front surface of the IC card and stepped portions to engage a raised surface portion formed on the back surface so that the raised surface portion can be moved in an IC card insertion/retraction direction X when the back surface of the IC card is supported on the support surface; and a top plate portion to keep the IC card from floating upward. The top plate portion has: a restriction surface to keep the IC card from floating upward; and a receiving groove to movably receive the raised surface portion of the back surface in the IC card insertion/retraction direction when the back surface of the IC card faces the restriction surface.

12 Claims, 18 Drawing Sheets

OTHER PUBLICATIONS

U.S. patent application Ser. No. 09/703,669, Ito et al., filed Nov. 2, 2000.
U.S. patent application Ser. No. 09/705,747, Ito et al., filed Nov. 6, 2000.
U.S. patent application Ser. No. 09/869,784 Ito, filed Nov. 2, 2000.
U.S. patent application Ser. No. 09/890,637, Abe et al., filed Aug. 3, 2001.

* cited by examiner

CARD CONNECTOR

This application is based on Patent Application No. 11-316108 filed Nov. 5, 1999 in Japan, the content of which is incorporated hereinto by reference.

BACKGROUND OF THE INVENTION

1. Field of the Invention

The present invention relates to a card connector for receiving an IC card such as memory card and more specifically to a card connector capable of protecting the IC card and the card connector from being damaged when the IC card is inserted in an inappropriate condition, e.g., upside down.

2. Description of the Related Art

Today the memory capacity is rapidly growing thanks to the remarkable advance of electronic circuit integration technology and there is a growing trend for using thin, small IC cards in the recording of various information such as characters, video and audio. Under this circumstance a variety of connectors for connecting the IC cards and electronic devices are being proposed and implemented.

FIG. 14A and FIG. 14B show one example of currently proposed IC card 1. As shown in the figure, the IC card 1 has a card body 2 incorporating an IC circuit in an almost rectangular case and a plurality of contact pads 3 connected to the IC circuit in the card body 2 and lead out from the card body 2 to an external front end of the body 2. The card body 2 is formed with a raised surface portion 4*a* protruding outwardly on its back surface 4 and also with a notched portion 5 at one corner.

The raised surface portion 4*a* is rectangular in shape with its width between the outer side surfaces set smaller than a width between outer side surfaces of the card body 2. On the back surface 4 side, steps are formed between the raised surface portion 4*a* and other surfaces, i.e., recessed surface portions 4*b*. The raised surface portion 4*a* shown here includes outer end faces 6*a* of a plurality of separation walls 6 formed in the front portion of the back surface 4 of the card body 2 to separate contact pads 3 from one another. The recessed surface portions 4*b* between the separation walls 6 are securely attached with the contact pads 3.

The notched portion 5 is formed by cutting one corner of the front part of the card body 2 at angle, which makes the front part of the card body 2 asymmetric with respect to the direction of card insertion (X direction).

FIG. 15 shows a card connector 10 for receiving the IC card. The card connector 10 has a connector body 11 for holding the IC card 1 so that it can be inserted and retracted, and also electric contacts 12 for making electric contact with the IC card 1 inserted into the connector body.

The connector body 11 has side portions 13, a bottom portion 14, and a top plate portion 15. The side portions 13 have guide surfaces 13*a* for guiding sides surfaces of the IC card 1. The bottom portion 14 has support surfaces 14*a* for supporting the back surface 4 or front surface 7 of the IC card 1 and stepped portions 14*b* that engage the raised surface portion of the IC card so that the raised surface portion 4*a* can be moved in the direction of IC card insertion and retraction. The top plate portion 15 keeps the IC card 1 from floating up. The electric contacts 12 are disposed to correspond to the contact pads 3 of the IC card 1 and held on the bottom portion 14 like cantilevered springs.

The connector body 11 is placed at a predetermined position on a printed circuit board of an electronic device, with the lower end portions of the electric contacts 12 soldered to predetermined conductive portions of the printed circuit board.

When the IC card 1 is to be connected to the card connector 10 of the above construction, it is inserted into the insertion direction (X direction) with the front surface 7 facing up, the back surface 4 supported on the support surfaces 14*a* and both of the outer side surfaces of the IC card 1 guided by both of the guide surfaces 13*a* of the connector body 11. At this time, the raised surface portion 4*a* formed on the back surface 4 of the IC card 1 engages the stepped portions 14*b* of the bottom portion 14 of the connector body 11 as the IC card 1 is inserted.

Then, when the front end portion of the IC card 1 engages an abutment portion 16 of the connector body 11 (see FIG. 18), the contact pads 3 contact the electric contacts 12, thus completing the connection (see FIG. 16). In this insertion operation, the IC card 1 is prevented from floating upward and getting dislocated by the inner surface of the top plate portion, so anyone can perform an insertion and connection operation easily and correctly.

In the connector shown in FIG. 15, as long as the IC card 1 is oriented correctly while being inserted, the connection to the card connector 10 can easily and reliably performed. When the IC card 1 is wrongly oriented and inserted, the card connector may be damaged. This is the problem with the conventional card connector that degrades the operability.

For example, when the IC card 1 is inserted upside down, as shown in FIG. 17, the raised surface portion 4*a* formed at the bottom of the IC card 1 and protruding upward abuts against the rear end of the top plate portion 15, as shown in FIG. 18. This state, however, is not a completely inserted state and there is a chance of the user further pushing the card with force.

In this case, because the raised surface portion 4*a* projects slightly above the top plate portion 15 as shown in FIG. 18, the IC card 1, when applied with a strong push, is forcibly inserted between the bottom portion 14 and the top plate portion 15 of the connector body 11, as shown in FIG. 19, deforming the top plate portion 15.

In the event of such a trouble, the side portions 13 of the IC card 1 are also deformed along with the top plate portion 15, exerting a load on soldered fittings on the side portions 13 of the connector body 11 used to secure the connector to the printed circuit board and also on soldered portions of the contacts, which in turn causes the soldered portions to come off, degrading the connection reliability of the connector.

The present invention has been accomplished to solve the above-described problems with the card connector and provide a card connector that can be prevented from being broken even when the IC card is wrongly inserted and maintain good connection reliability.

SUMMARY OF THE INVENTION

The present invention has been accomplished to solve the problems described above and provide a card connector having a connector body for removably holding an inserted IC card formed with a raised surface portion on a back surface side and electric contacts for making electrical contact with the IC card inserted in the connector body, the connector body comprising: side portions having guiding surfaces to guide side surfaces of the inserted IC card; a bottom portion having a support surface to support a back surface or front surface of the inserted IC card and stepped portions to engage the raised surface portion formed on the back surface so that the raised surface portion can be moved in an IC card insertion/retraction direction when the back surface of the IC card is supported on the support surface; and a top plate portion disposed opposite the bottom portion to keep the inserted IC card from floating upward; wherein the top plate portion has a restriction surface disposed opposite a recessed portion formed in the back surface of the IC card or the front surface of the IC card to keep the IC card from floating upward, and a receiving groove to movably receive the raised surface portion of the back surface in the IC card insertion/retraction direction when the front surface of the IC card is supported on the support surface.

The card body has a front portion that is formed laterally asymmetric with respect to the insertion direction by forming a notch portion at one part of the rectangular card body; the connector body has an abutment portion and a protruding portion, the abutment portion engaging a front end face of the IC card and the protruding portion engaging the notch portion when the IC card is inserted with a recessed portion formed in the back surface of the IC card supported on the support surface and reaches a predetermined connected position; and when the IC card is inserted with the front surface of the IC card supported on the support surface, the protruding portion engages the front portion of the IC card to block the insertion of the IC card at a position short of the connected position with respect to the insertion direction.

The receiving groove is formed to extend from behind a blocking position, with respect to the IC card insertion direction, to a rear end of the top plate portion, the blocking position being a position where the front portion of the IC card engages the protruding portion when the IC card is inserted with its surface supported on the support surface.

The raised surface portion of the IC card is rectangular in shape and has its side surfaces situated inwardly of side surfaces of the card body, the receiving groove is formed by a recessed groove extending inwardly from a rear end of the top plate portion with respect to the IC card insertion direction and spanning slightly wider than the raised surface portion, and the top plate portion is U-shaped when viewed from above.

The receiving groove is formed by a recessed surface portion which is recessed from the restriction surface of the top plate portion.

The top plate portion is formed with at least one bulging portion which bulges rearwardly with respect to the IC card insertion direction and which is spaced from both of the side portions.

The above and other objects, features and advantages of the present invention will become more apparent from the following description of embodiments thereof taken in conjunction with the accompanying drawings.

DETAILED DESCRIPTION OF THE PREFERRED EMBODIMENTS

Figure 1:
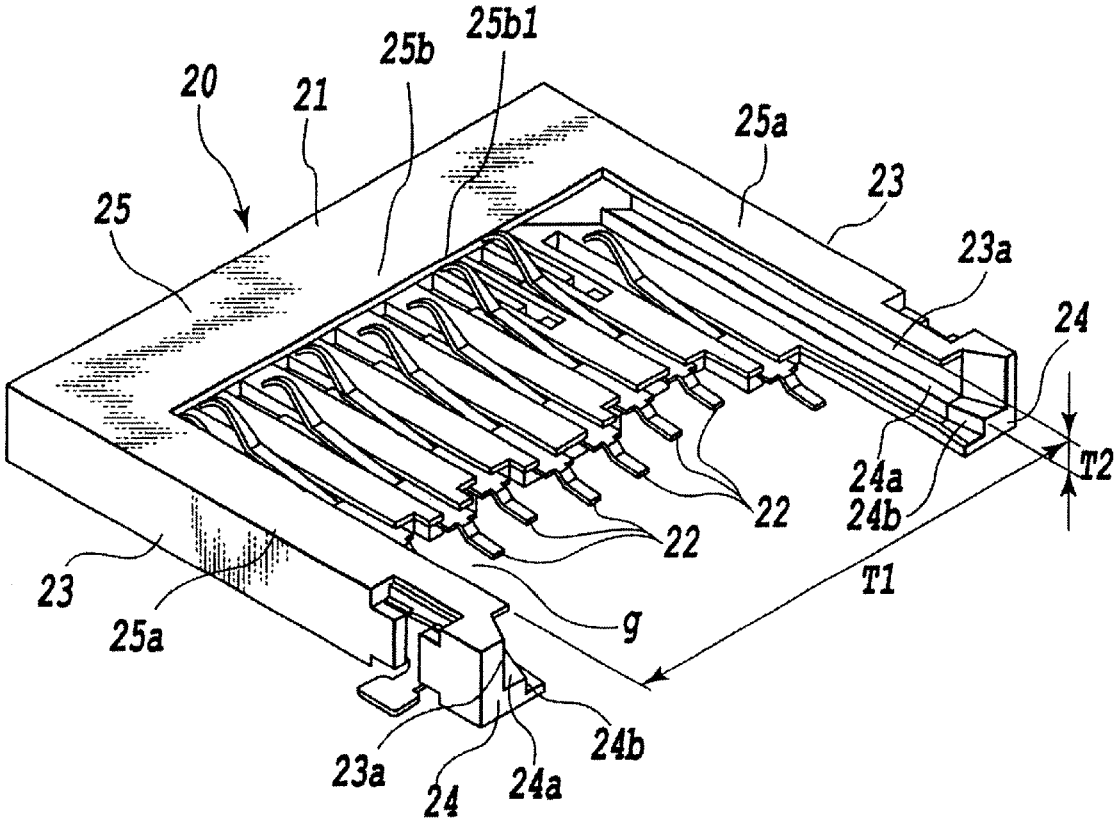
FIG. 1 is an external perspective view of a card connector according to a first embodiment of the invention.

Now, preferred embodiments of the present invention will be described by referring to the accompanying drawings.

FIGS. 1 to 9 show a card connector according to the first embodiment of the invention. Elements identical with those of the prior art are give like reference numerals.

Figure 14A:
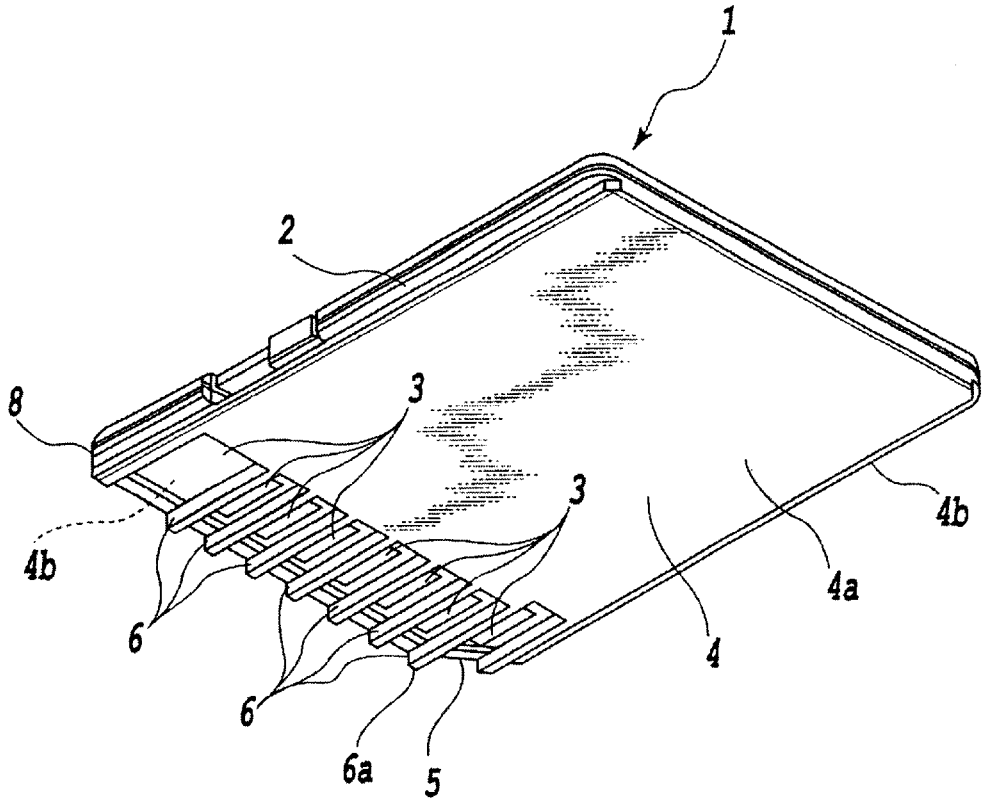
FIG. 14A and FIG. 14B are perspective views of the IC card, FIG. 14A showing the IC card from the back surface side and FIG. 14B showing the IC card from the front surface side.
Figure 14B:
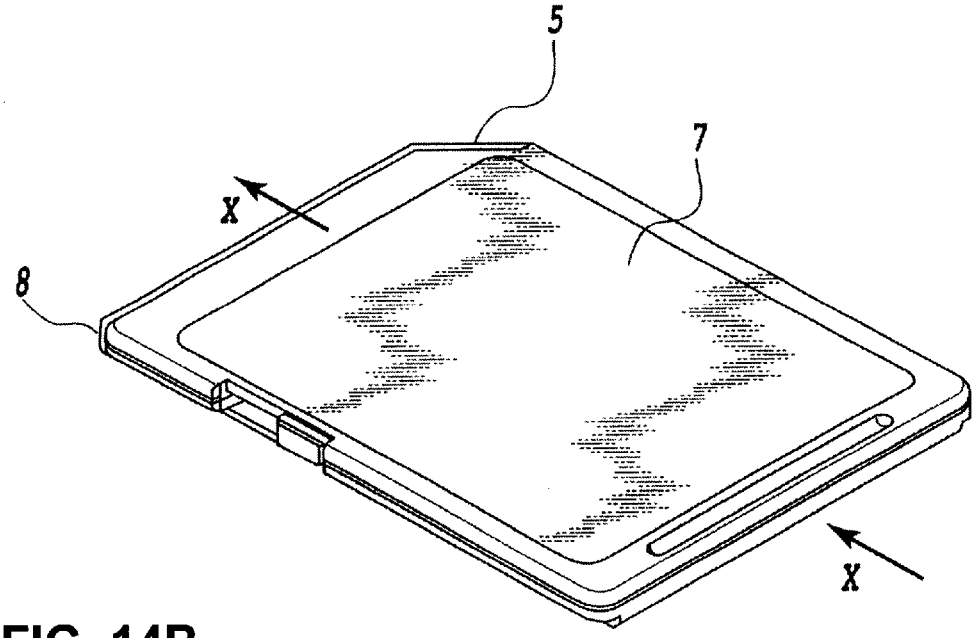
Figure 15:
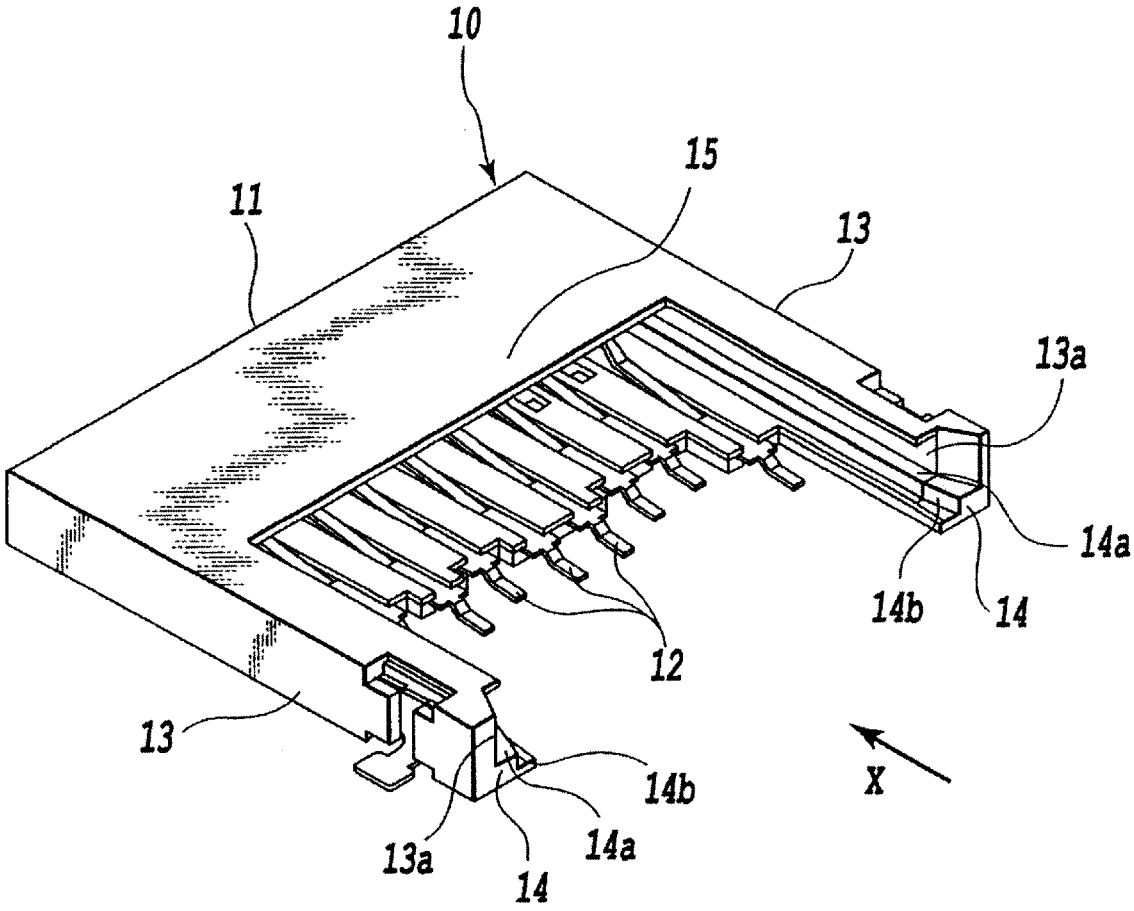
FIG. 15 is a perspective view of a card connector according to a prior art of the invention.
Figure 16:
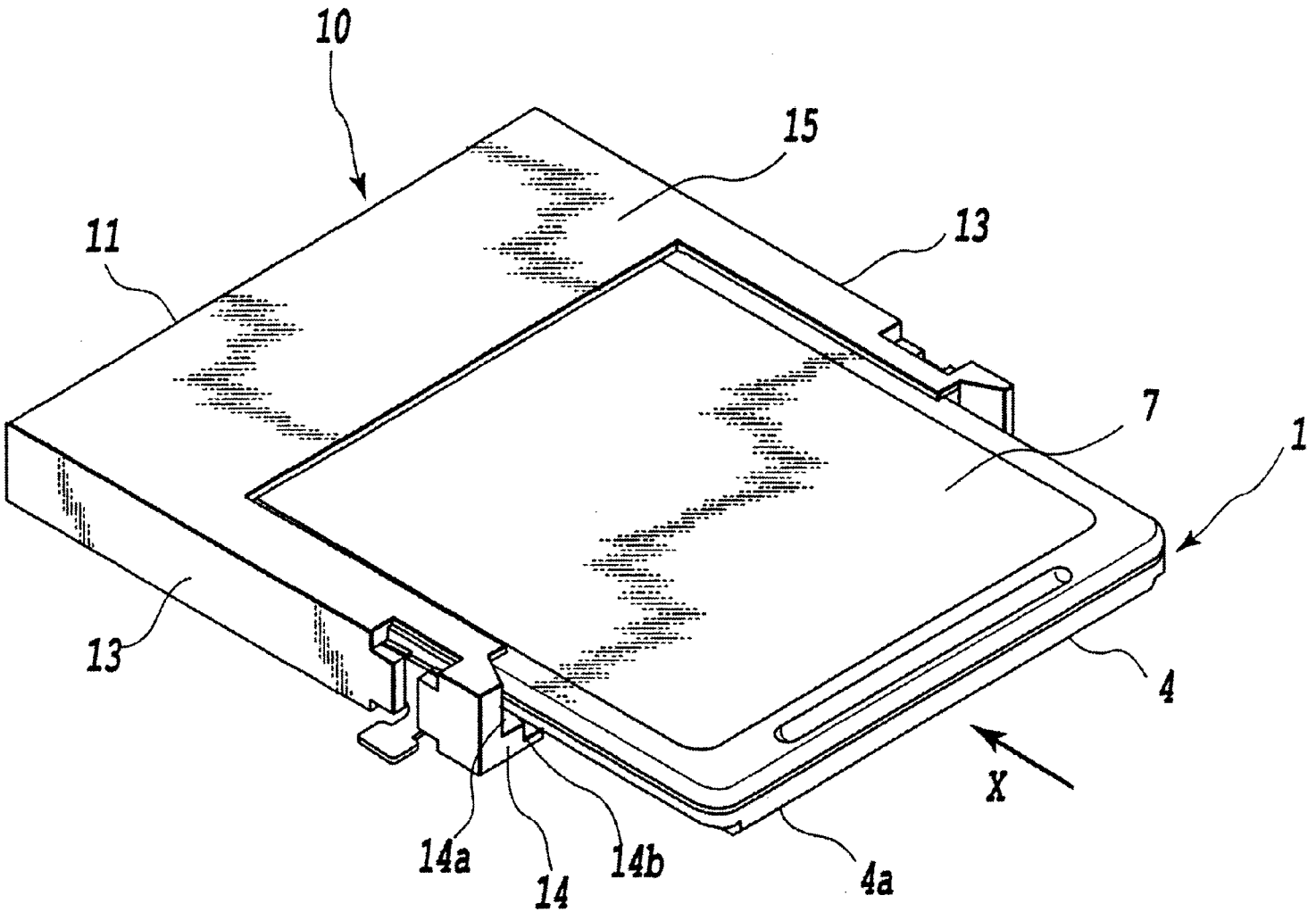
FIG. 16 is a perspective view showing the IC card inserted in an appropriate orientation into the card connector of FIG. 15.
Figure 17:
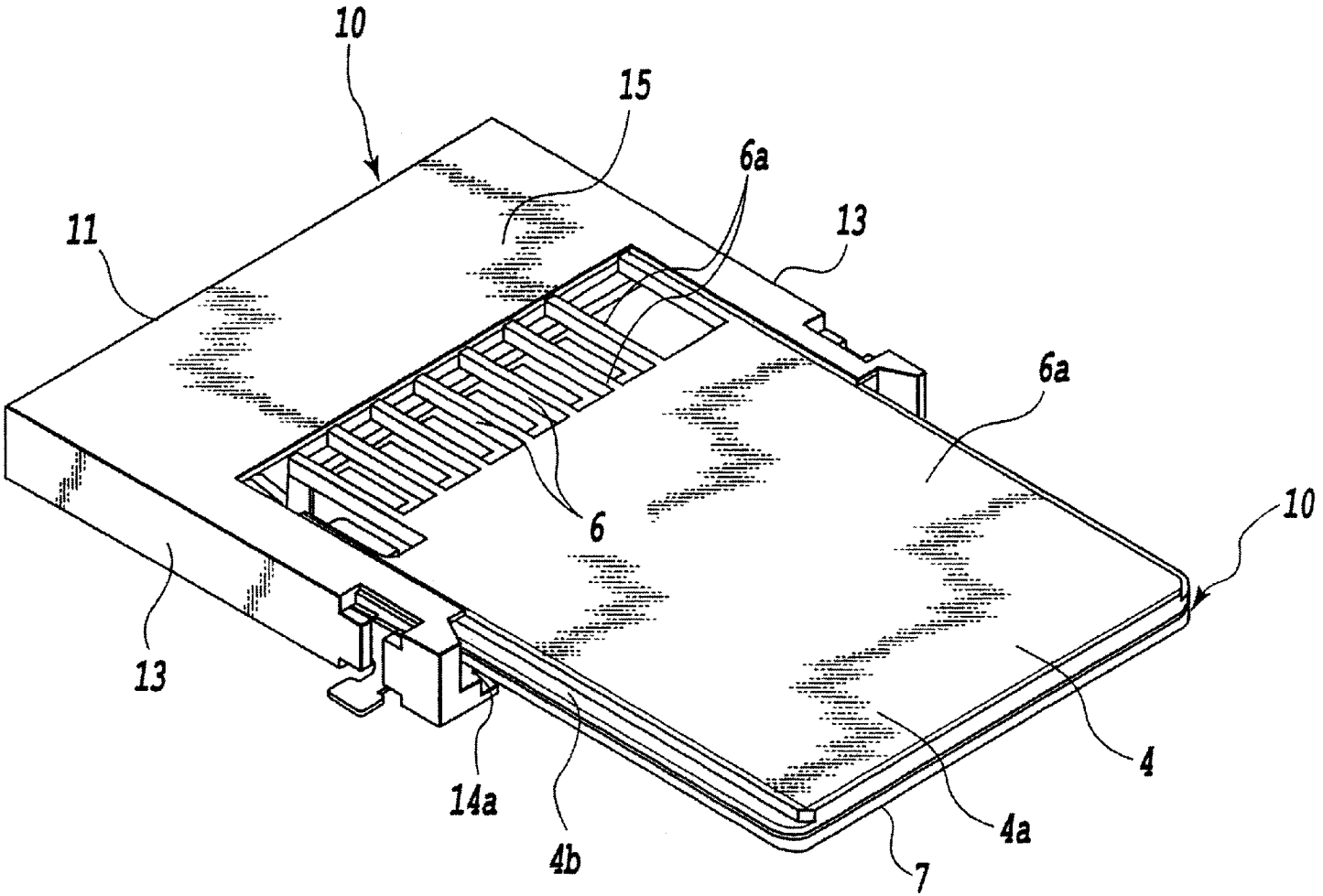
FIG. 17 is a perspective view showing the IC card inserted in an inappropriate orientation into the card connector of FIG. 15.
Figure 18:
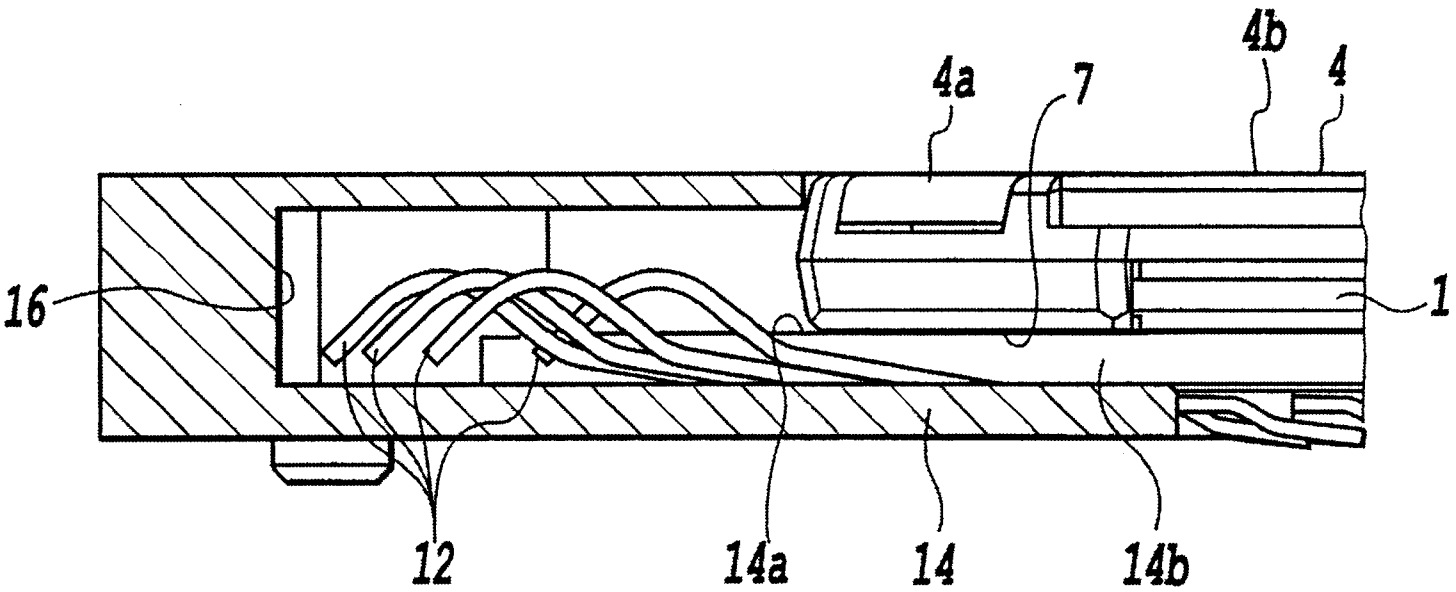
FIG. 18 is a vertical cross-sectional side view showing the IC card inserted in an inappropriate orientation into the card connector of FIG. 15 with a raised surface portion of the IC card abutting against a top plate portion.
Figure 19:
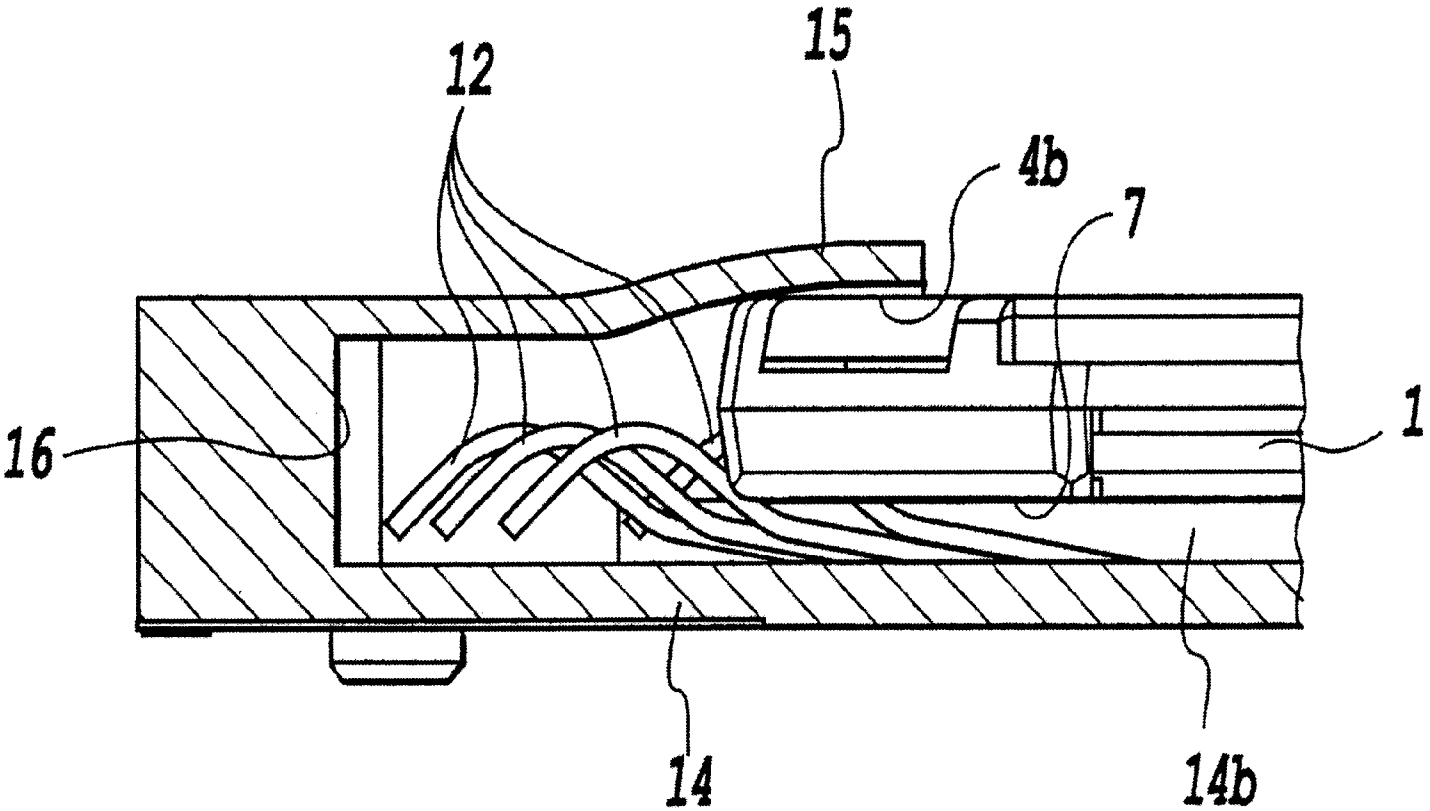
FIG. 19 is a vertical cross-sectional side view showing the IC card further inserted from the state of FIG. 18.

An IC card 1 applied to the connector of the first embodiment is similar to the one shown in FIG. 14 and therefore its explanation is omitted here.

A connector 20 of the first embodiment comprises a connector body 21 which holds the IC card 1 so that it can be inserted into and retracted from the connector body, and electric contacts 22 that make electrical contact with the IC card 1 inserted into the connector body 21. The connector body 21 has side portions 23, a bottom portion 24, a top plate portion 25, and an abutment portion 26. The side portions 23 have guide surfaces 23*a* for guiding left and right outer side surfaces of the IC card 1. The bottom portion 24 has support surfaces 24*a* that support a back surface 4 or front surface 7 of the IC card 1 and stepped portions 24*b* that, when they support the back surface of the IC card 1, engage a raised surface portion 4*a* formed on the back surface 4 so that the raised surface portion 4*a* can be moved in the direction of IC card insertion and retraction. The top plate portion 25 is disposed opposite the bottom portion 24 to keep the IC card 1 from floating up as it is inserted. The abutment portion 26 abuts against a front end of the IC card 1 to lock it at the properly inserted position or connected position when it is inserted in an appropriate condition. The side portions 23, bottom portion 24, electric contacts 22 and abutment portion 26 are similar in construction to those shown in FIGS. 15 to 19.

Figure 6:
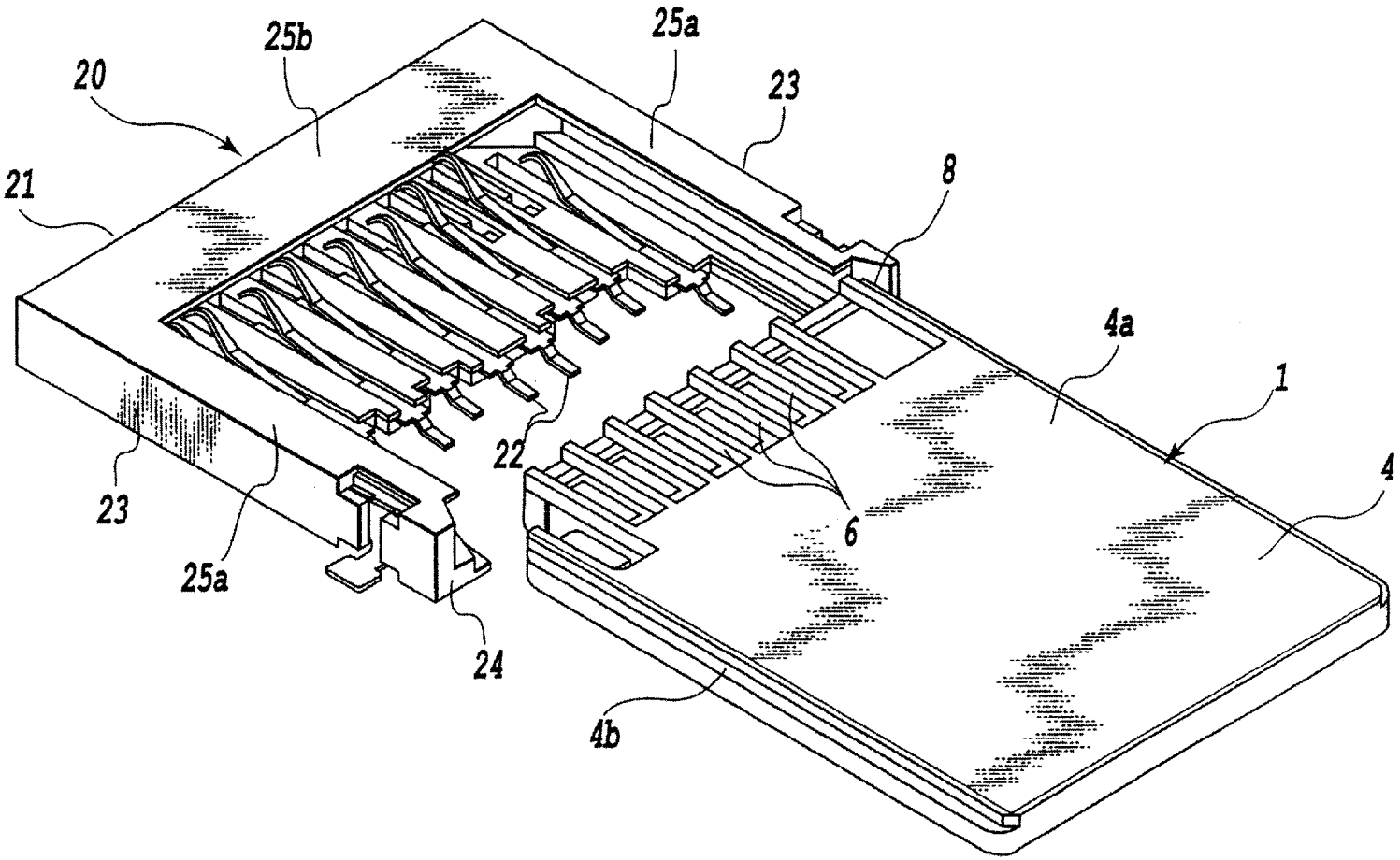
FIG. 6 is a perspective view showing the IC card being inserted in an improper orientation into the card connector of FIG. 1.

The connector body 21 has an erroneous insertion prevention structure which prevents the IC card 1 from being inserted to the connected position when the IC card 1 is inserted in an improper condition as shown in FIG. 6, i.e., with the front surface 7 of the IC card 1 supported on the support surfaces 24*a* of the bottom portion 24.

Figure 2:
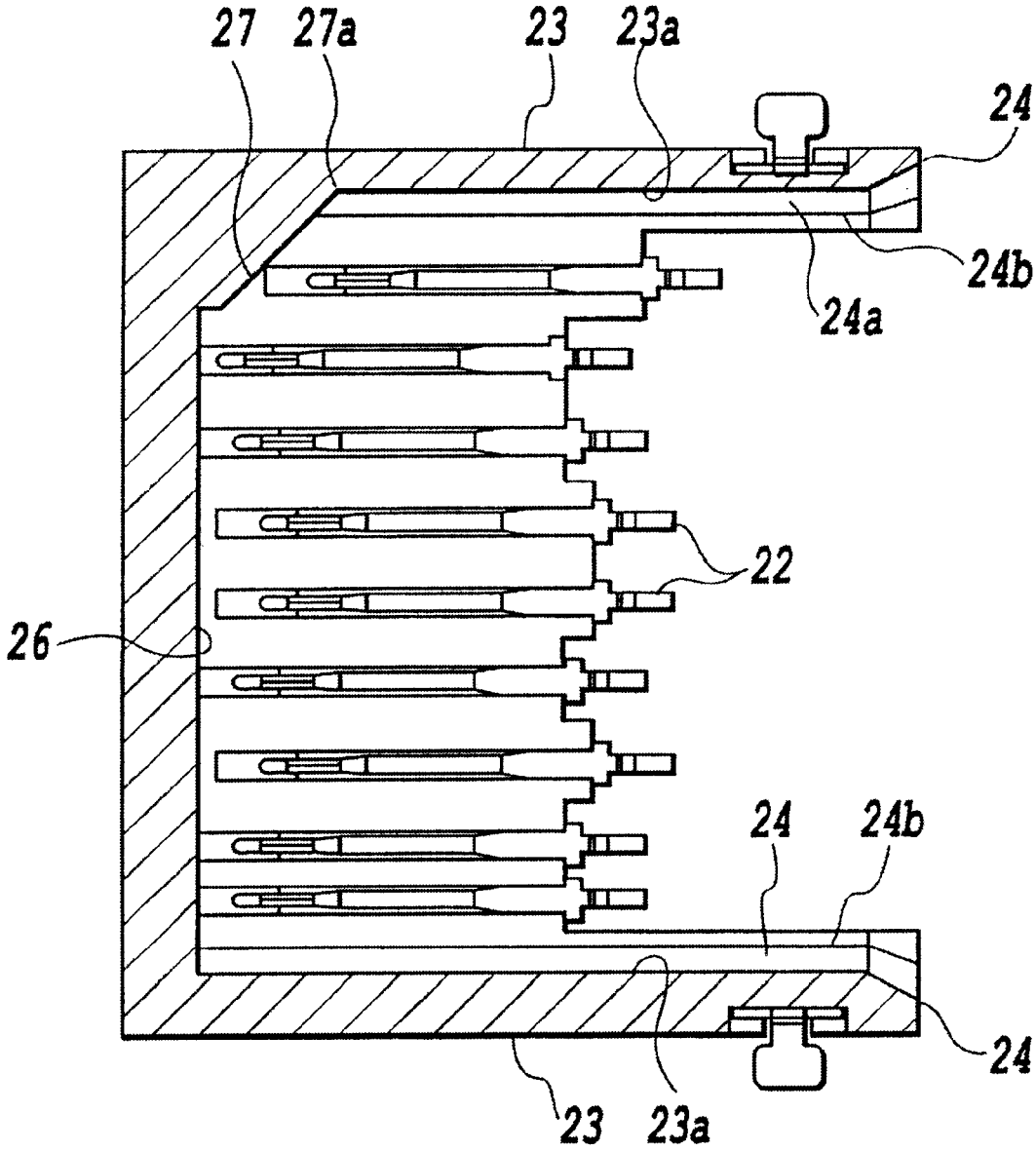
FIG. 2 is a horizontal cross section showing a bottom portion of the first embodiment of the invention.
Figure 3:
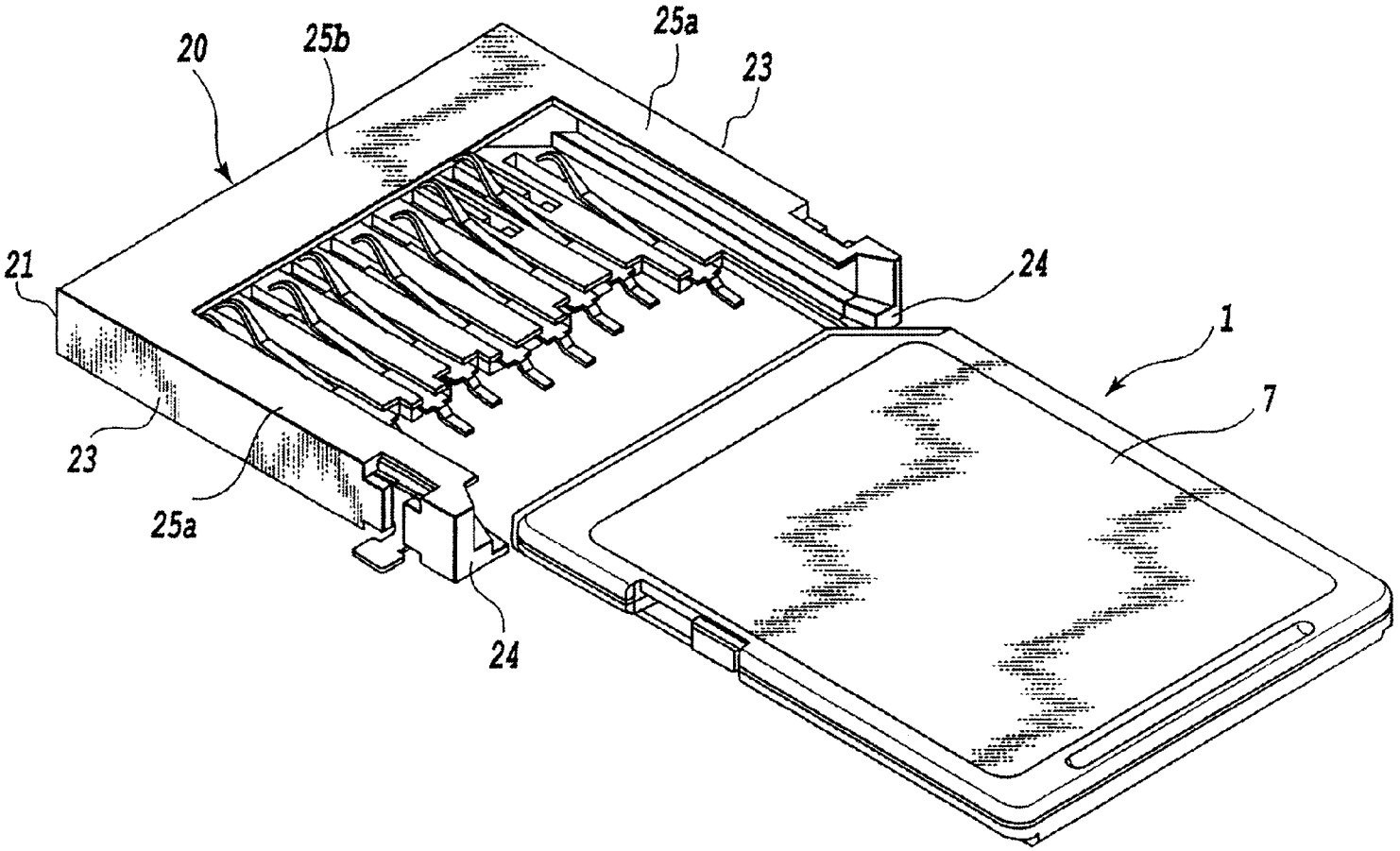
FIG. 3 is a perspective view showing an IC card being inserted in an appropriate orientation into the card connector of FIG. 1.
Figure 4:
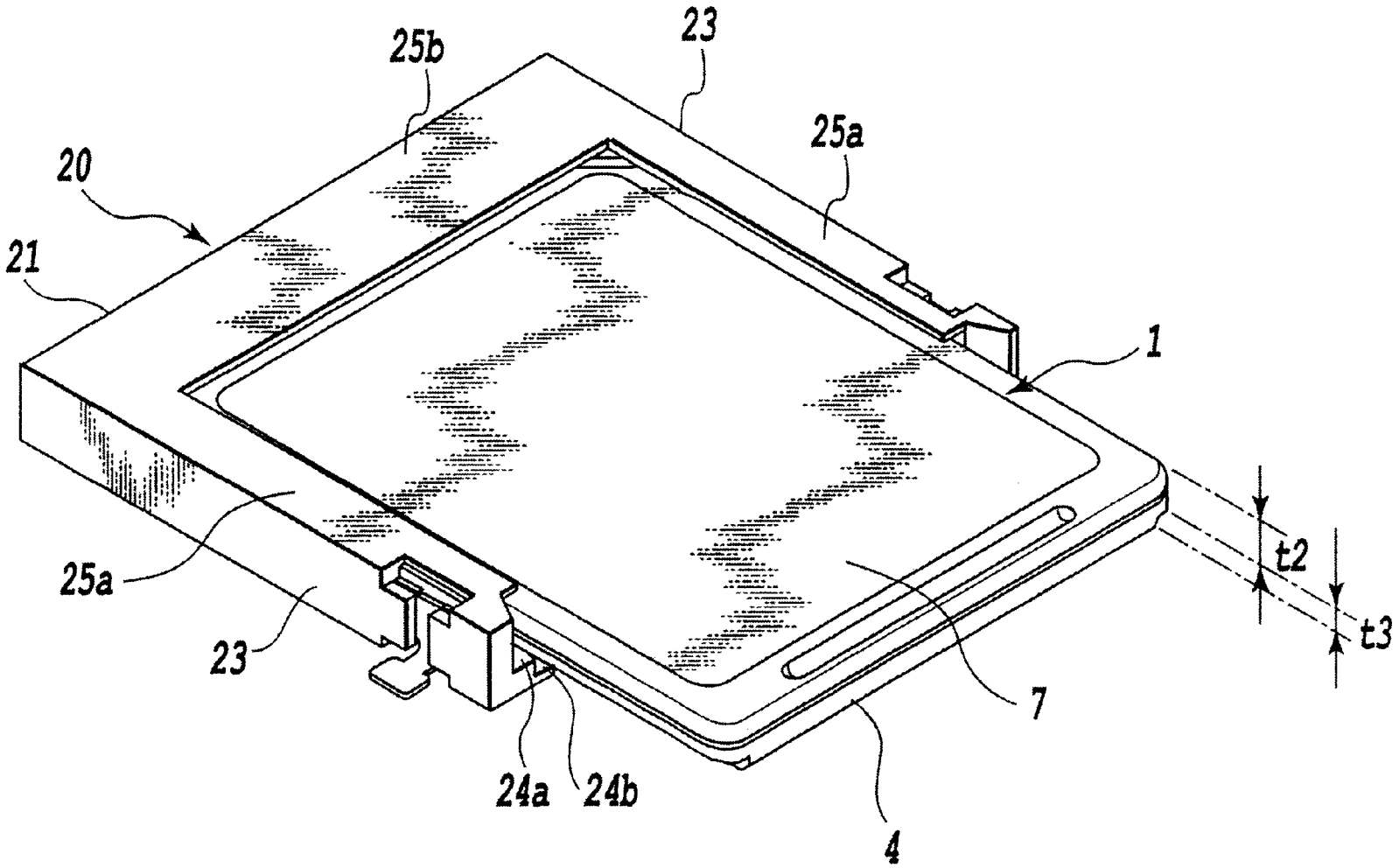
FIG. 4 is a perspective view showing the IC card inserted from the state of FIG. 3 to a properly inserted position or connected position in the card connector.
Figure 5:
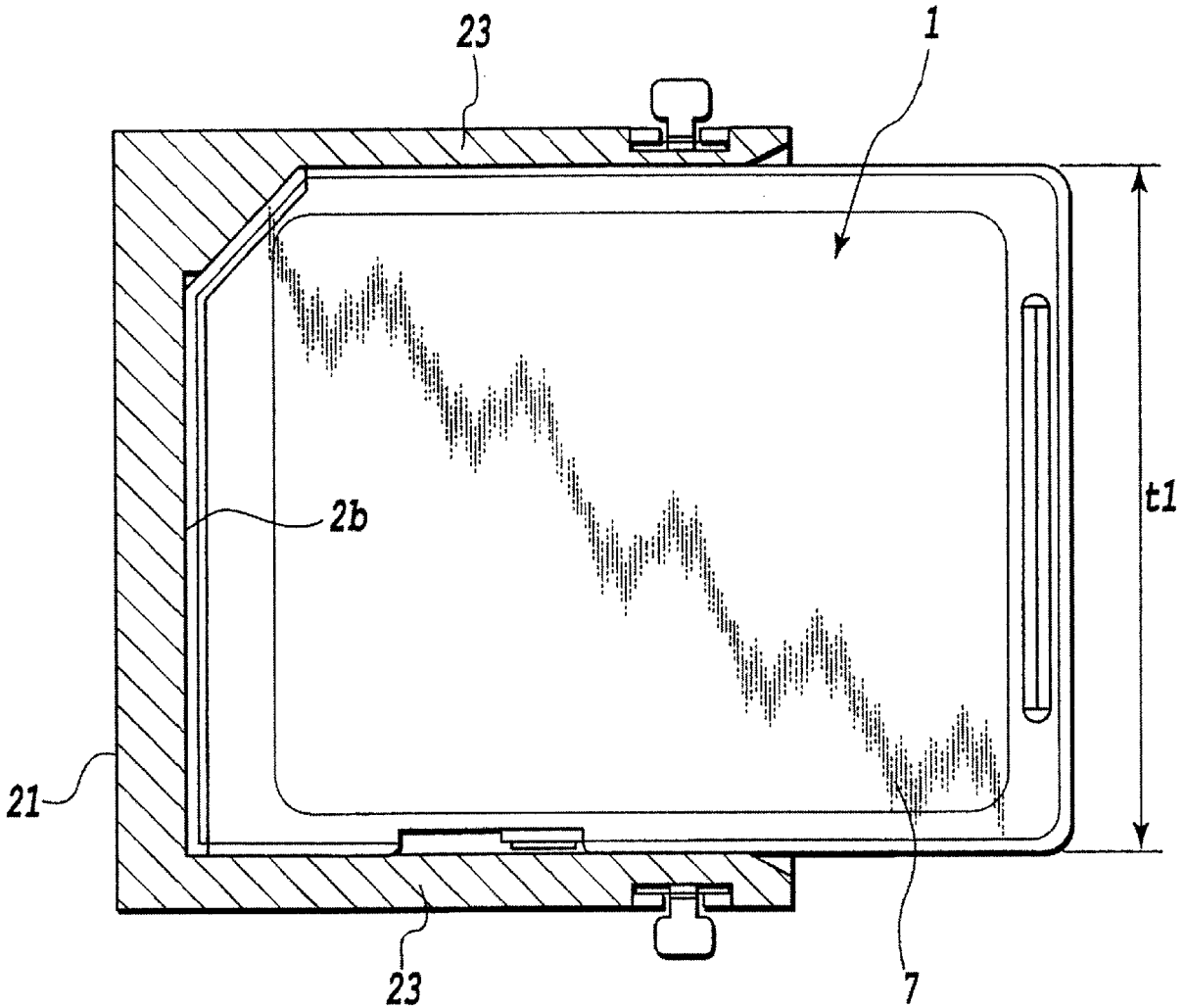
FIG. 5 is a horizontal cross section showing the IC card of FIG. 4 inserted in a card connected state.

The erroneous insertion prevention structure, as shown in FIG. 2, comprises a protruding portion 27 that protrudes from the bottom portion 24 of the connector body 21. The protruding portion 27 is formed as an inclined surface at one corner of the connector body 21, extending from the abutment portion 26 to the guide surface 23*a* of one of the side portions 23. When the IC card 1 is held in the correct orientation as shown in FIG. 3 and inserted into the connector body 21, with the back surface 4 of the IC card 1 supported on the bottom portion 24 of the connector body 21 as shown in FIG. 4, the front end of the IC card 1 engages the abutment portion 26 of the connector body as shown in FIG. 5, preventing further insertion. At the same time, the notched portion 5 of the IC card 1 comes close to the protruding portion 27. At this point, the inserted position of the IC card 1 is a properly inserted position or connected position, bringing the contact pads 3 into contact with the electric contacts 22 of the connector 20 with an appropriate pressure.

Figure 8:
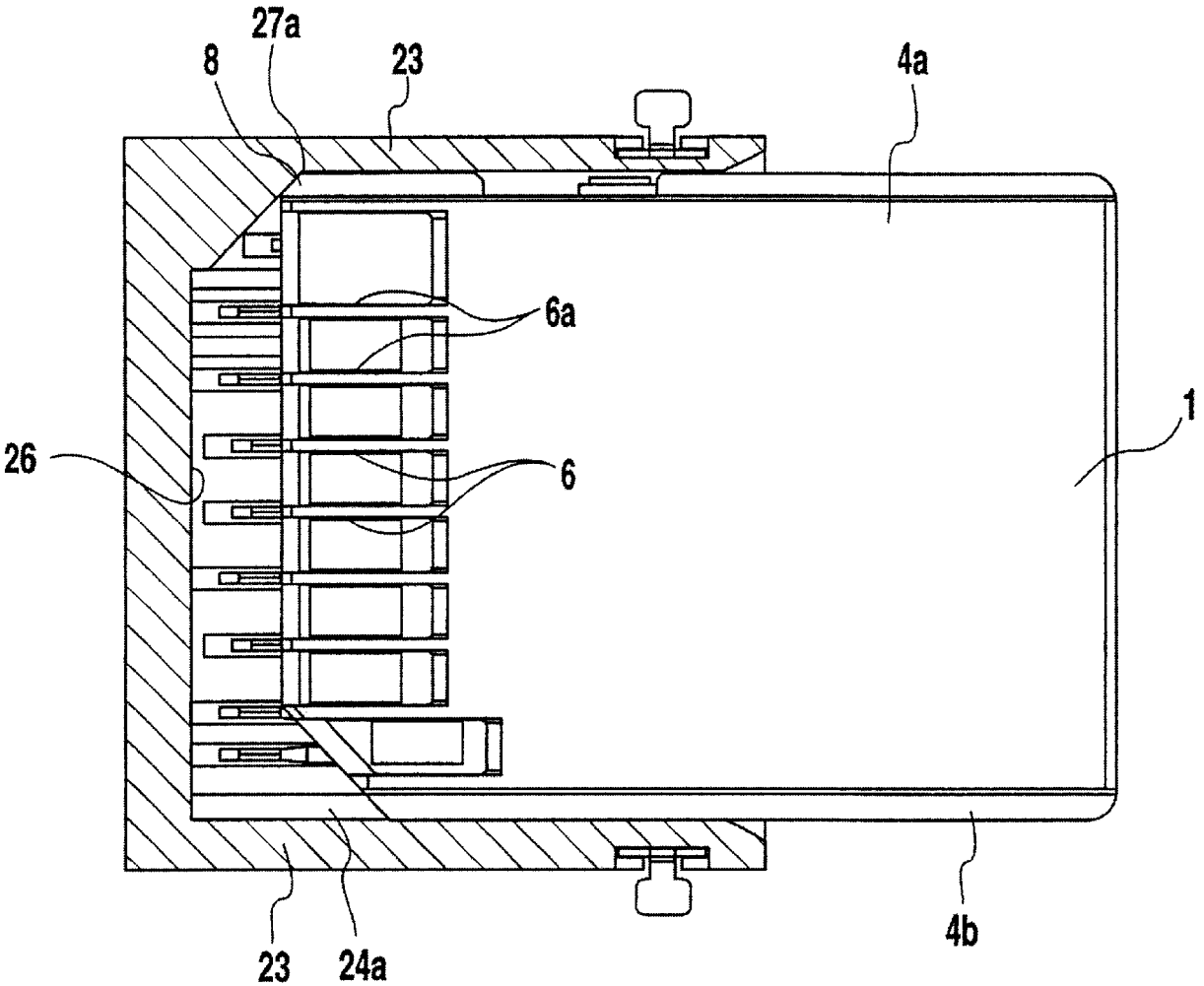
FIG. 8 (Prior Art)
FIG. 8 is a horizontal cross section showing the IC card of FIG. 7 in an inserted state.

When on the other hand the IC card 1 is inserted in an inappropriate orientation as shown in FIG. 6, with the front surface 7 of the IC card 1 supported on the support surfaces 24*a* of the connector body 21, one rectangular corner of the IC card 1 engages a rear end portion 27*a* of the protruding portion 27 formed on the connector body 21 and further insertion is blocked before the IC card 1 reaches the connected position as shown in FIG. 8.

Hence, the IC card 1 apparently remains projected rearwardly with respect to the insertion direction from the connected position, allowing the user to recognize that the IC card 1 was wrongly inserted.

The top plate portion 25 in the first embodiment is formed as follows.

The top plate portion 25 of the connect or 20 in the first embodiment disposed opposite the bottom portion 24 of the connector body 21 protrudes like eaves and has integrally formed therewith a pair of left and right side restriction portions 25*a* protruding inwardly from the upper ends of the left and right side portions 23 away from the guide surfaces 23*a* and a front restriction portion 25*b* protruding inwardly from the upper end of the abutment portion 26. The top plate portion 25 therefore is U-shaped as a whole when viewed from above.

The top plate portion 25 is formed with a rectangular engagement groove g which is enclosed on three sides by the edge of the top plate portion with one side cur away. A lateral width T1 of the engagement groove g (i.e., the width in a direction perpendicular to the IC card 1 insertion direction) is set slightly larger than a lateral with t1 of a raised portion 4*a* of the IC card. A distance T2 from the underside of the top plate portion 25 of the connector 20 to the support surfaces 24*a* of the bottom portion 24 is set slightly larger than a distance (thickness) t2 from a recess surface portion 4*b* of the IC card 1 to the front surface 7.

A rear end portion 25*b*1 of the front restriction portion 25*b* is situated between the rear end portion 27*a* of the protruding portion 27 (an intersecting portion between the inclined surface of the protruding portion 27 and the guide surface 23*a* of the side portion 23) and the abutment portion 26.

The connector 20 of the first embodiment with the above construction can therefore be protected against being damaged even when the IC card is wrongly inserted.

Figure 7:
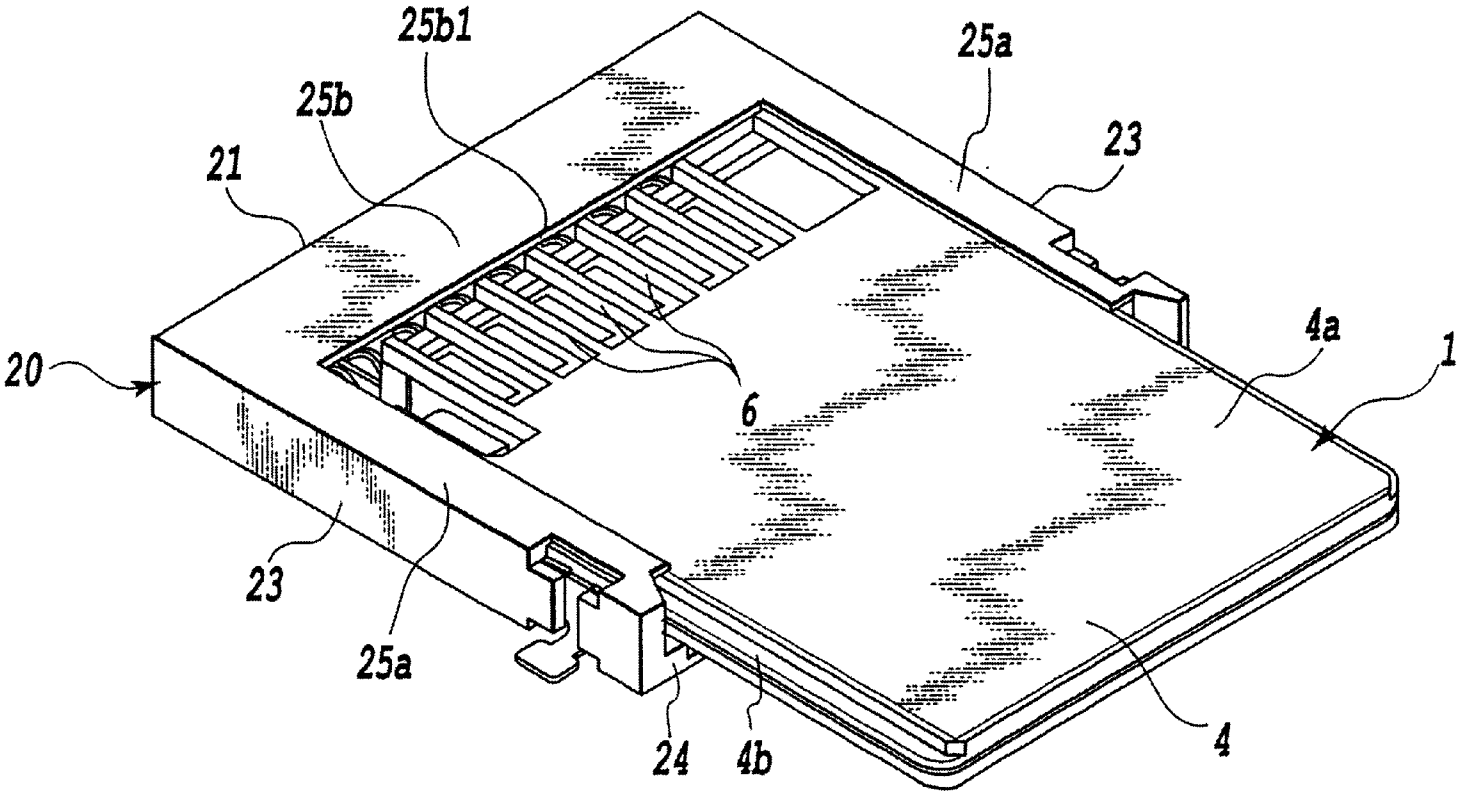
FIG. 7 (Prior Art)
FIG. 7 is a perspective view showing the IC card inserted from the state of FIG. 6 to a position where a corner of the IC card abuts against a protruding portion of the card connector.
Figure 9:
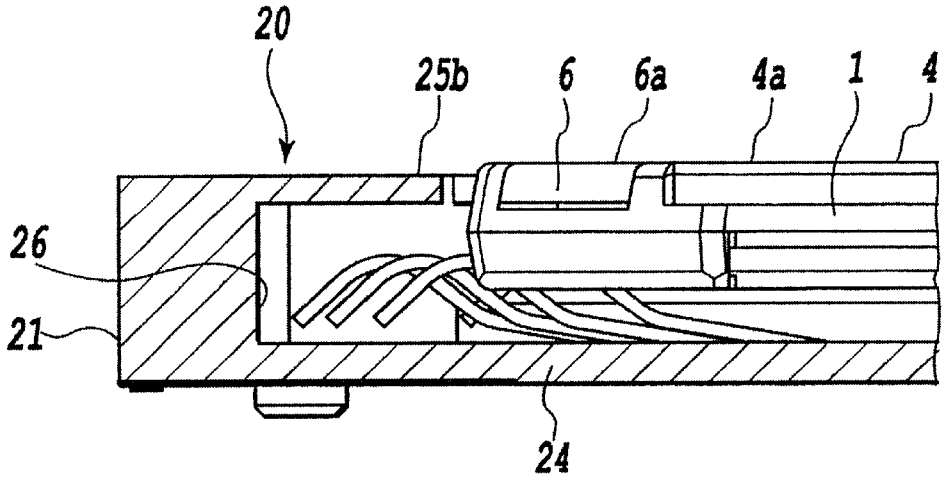
FIG. 9 (Prior Art)
FIG. 9 is a vertical cross-sectional side view showing the IC card of FIG. 7 in the inserted state.

That is, when the IC card 1 is wrongly inserted as shown in FIG. 7, the IC card 1 is blocked at a position well short of the connected position by the engagement between the almost right-angled corner 8 and the rear end portion 27*a* of the protruding portion 27 as described earlier and further insertion is prevented. At this point the front end portion of the raised surface portion 4*a* of the IC card 1 is situated behind the front restriction portion 25*b* with respect to the insertion direction, as shown in FIG. 9, and thus does not interfere with the front restriction portion 25*b*. In the first embodiment, therefore, if the card is wrongly inserted, the card connector 20 can be protected against being damaged and maintain the connection reliability.

When the IC card 1 is inserted in a correct orientation, the undersides of the side restriction portions 25*a* and the front restriction portion 25*b* of the top plate portion 25 (restriction surfaces) keep the IC card 1 from floating to ensure that the IC card 1 can be introduced smoothly and reliably to the connected position.

Figure 10:
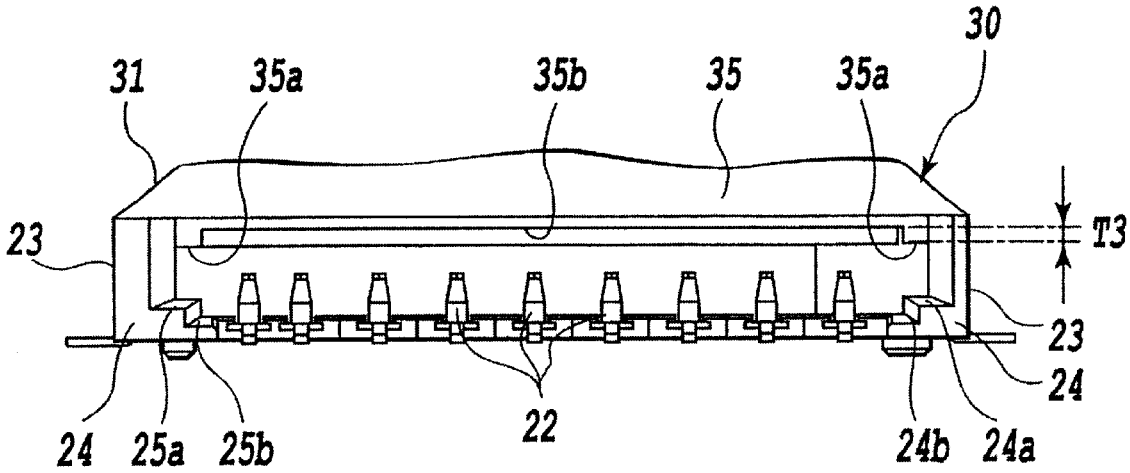
FIG. 10 (Prior Art)
FIG. 10 is a partly cutaway perspective view of a card connector according to a second embodiment of the invention as viewed from the front side.
Figure 11:
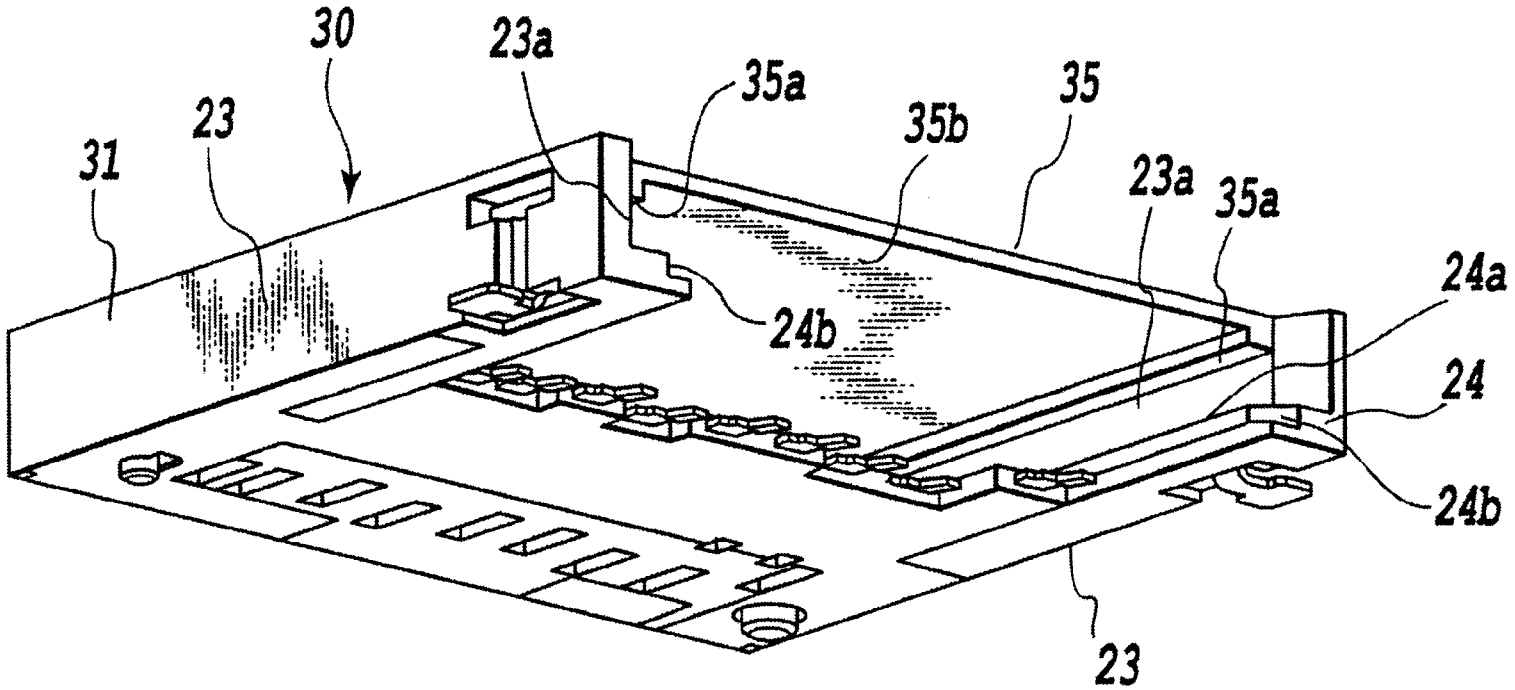
FIG. 11 (Prior Art)
FIG. 11 is a perspective view of the card connector of FIG. 10 as viewed from the bottom side.
Figure 12:
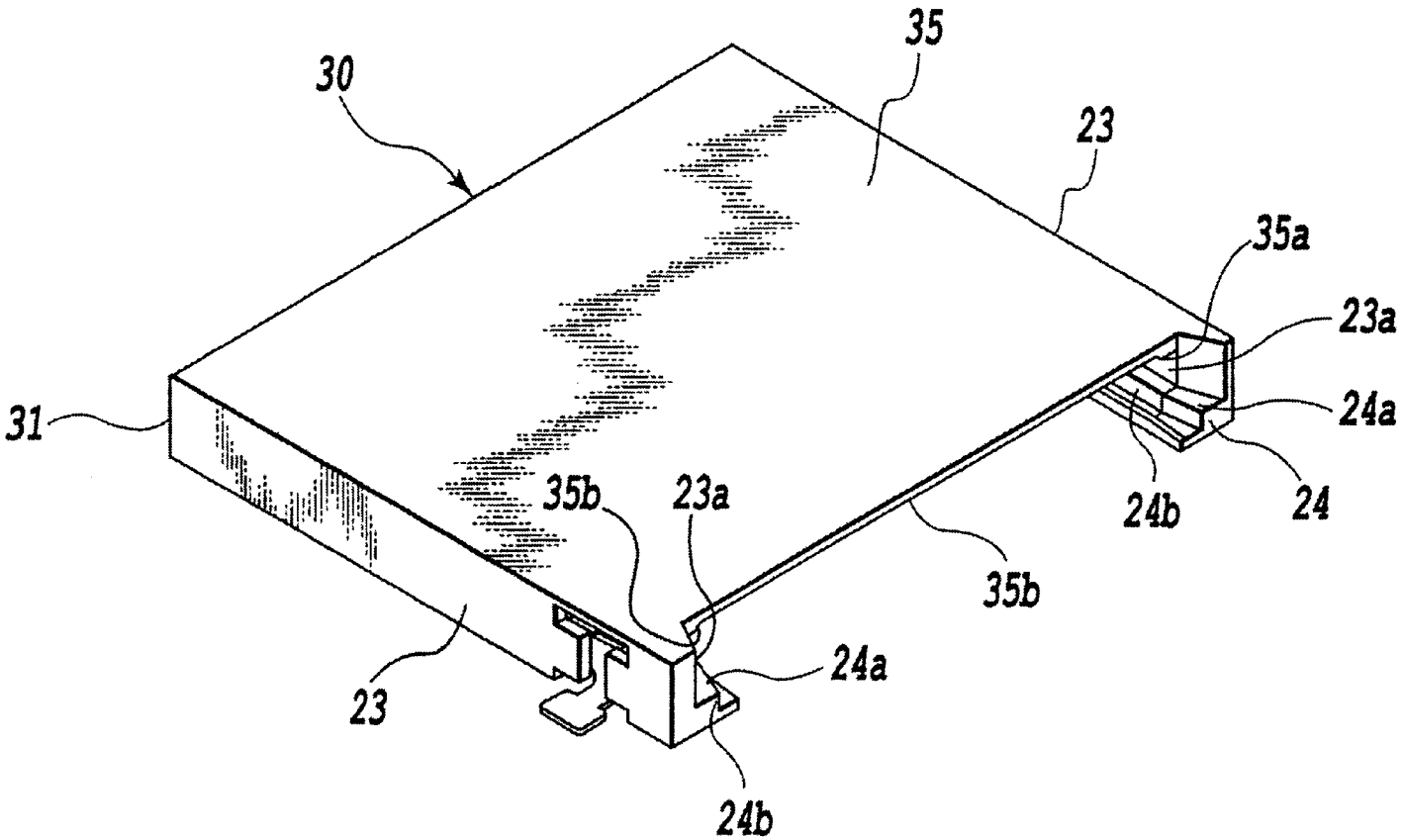
FIG. 12 (Prior Art)
FIG. 12 is a perspective view of the card connector of FIG. 11 as viewed from the top slide.

Next, the second embodiment of the invention will be described by referring to FIGS. 10 to 12. Elements identical to or corresponding to those of the first embodiment are given like reference numerals and their explanations are omitted.

In the first embodiment, the top plate portion 25 that prevents the IC card 1 from floating when it is inserted in the correct orientation has been described to be shaped like a letter U when viewed from above. A connector body 31 of a card connector 30 according to the second embodiment has a top plate portion 35 that is rectangular when viewed from above and which covers almost entirely the inserted portion of the IC card 1.

The underside of the top plate portion 35 is formed with restriction surfaces 35*a* extending longitudinally along both sides and with a recessed surface portion 3*b* recessed upwardly from the restriction surfaces 35*a* to function as an engagement groove. The restriction surfaces 35*a* face the support surfaces 24*a* of the bottom portion 24 and their distance is set slightly larger than a distance t2 between the recessed surface portions 4*b* and the front surface 7 of the IC card 1. A distance T3 between the recessed surface portion 35*b* and the restriction surfaces 35*a* is set slightly larger than a distance t3 between the raised surface portion 4*a* and the recessed surface portions 4*b* of the IC card 1. Other structural aspects are similar to those of the first embodiment.

In the second embodiment constructed as described above, even when the IC card 1 is inserted wrongly in an inverted orientation, the recessed surface portions 4*b* of the IC card 1 face the restriction surfaces 35*a* with a minute gap therebetween and the raised surface portion 4*a* bulged upwardly faces the recessed surface portion 35*b* with a minute gap therebetween. Hence, the IC card 1 is inserted easily into the connector body 31. As in the first embodiment, the IC card 1 is blocked at a position short of the connected position (i.e., at a position where the abutment portion 26 and the front end portion of the IC card 1 engage)

by the engagement between the corner 8 of the IC card 1 and the protruding portion 27. Thus, even when the card is wrongly inserted, the top plate portion 35 is prevented from being deformed or broken, thus maintaining the reliability of the connector.

When the IC card 1 is inserted in an appropriate state, the restriction surfaces 35*a* keep the IC card 1 from floating, guiding the IC card 1 smoothly and properly to the connected position. Further, in the second embodiment, because the top plate portion 35 is rectangular in shape, it serves as a reinforcement member to increase the rigidity of the connector 30 as a whole and also helps protect the IC card and prevent ingress of dust.

Although we have explained example cases having the erroneous insertion prevention structure, the present invention can be applied to card connectors that have no such erroneous insertion prevention structure. For example, in the second embodiment, when the erroneous insertion prevention structure is eliminated from the card connector, the recessed surface portion 35*b* need only being formed in the top plate portion 35, extending from the rear end, with respect to the insertion direction, to the engagement portion. With this construction, if the wrongly oriented IC card 1 is inserted to the connected position, there is no possibility of the top plate portion 35 being broken.

Further, in the case of a card connector which is removed of the erroneous insertion prevention structure in the first embodiment, the front restriction portion 25*b* of the top plate portion 25 need only be eliminated up to or up to near the position where the abutment portion 26 is formed. In this case, although the card floating prevention effect by the fron restriction portion 25*b* as provided in the first embodiment cannont be expected, the side restriction portions 25*a* can prevent that upward floating of the IC card 1. Depending on the width of the raised surface portion 4*a* of the IC card 1 and the width of the side restriction portion 25*a*, a satisfactory floating prevention effect can be expected.

Figure 13:
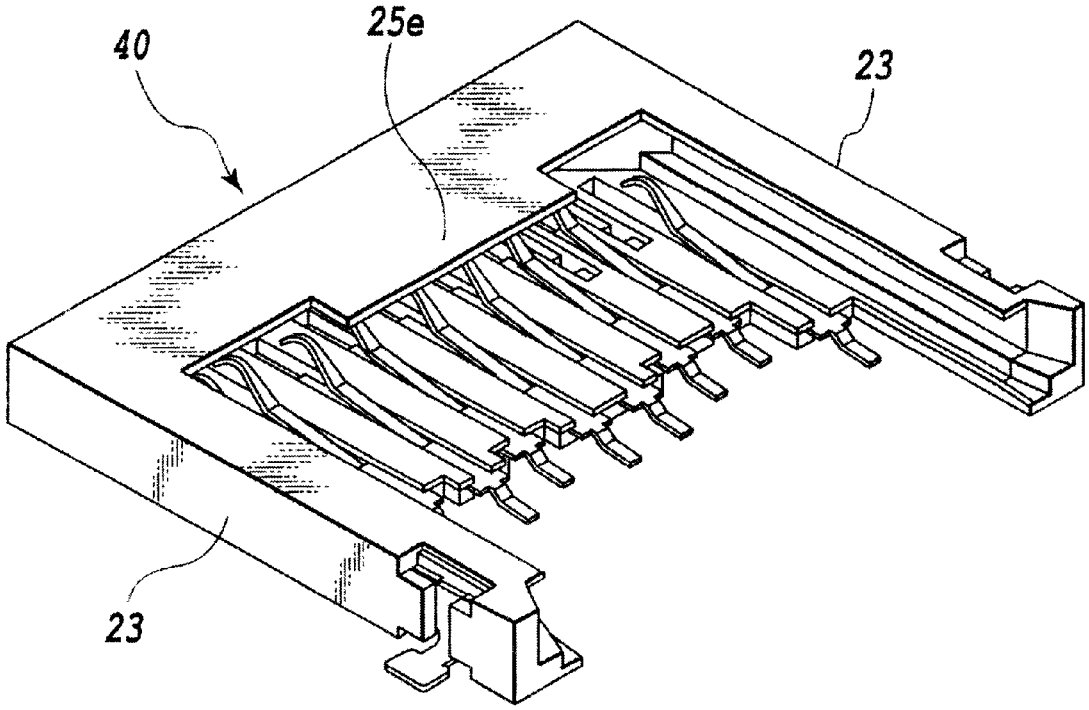
FIG. 13 (Prior Art)
FIG. 13 is a perspective view of a card connector according to a third embodiment of the invention.

The top plate portion in this invention is not limited in shape to those of the first and second embodiment but may be formed into other shapes. For example, as shown in FIG. 13, the front restriction portion 25*b* of the first embodiment may be formed with an intermediate bulging portion 25*e* spaced from the side portions 23. With this construction, the intermediate bulging portion 25*e* can keep the IC card 1 from floating more reliably.

This kind of card connector is typically mounted on a printed circuit board by using a vacuum suction pad, an automated machine that holds the card connector by suction and moves it to the mounting position. The intermediate bulging portion 25*e* provides a wider suction area and thereby can reduce the possibility of failure to hold the connector by suction, thus enhancing the productivity.

The card connector 40 having the intermediate bulging portion 25*e* is most preferably applied to an IC card 1 which has no raised surface portion 4*a* at a position corresponding to the intermediate bulging portion 25*e* but which has a back surface formed instead with the recessed surface portion 4*b*. But it is also applicable to an IC card 1 that is formed with the raised surface portion 4*a* at a position corresponding to the intermediate bulging portion 25*e*. That is, if the wrong insertion of the IC card 1 causes its raised surface portion 4*a* to press against the intermediate bulging portion 25*e* and deform it, the deformation of the intermediate bulging portion 25*e*, because it is spaced from the side portions 23, does not affect the side portions 23 or destroy the soldered portions of the card connector.

The intermediate bulging portion 25*e* is not limited in shape to that of the third embodiment shown in FIG. 13 but may be formed into any desired shape, for example, the shape of the IC card, or divided into a plurality of pieces according to the shape of the back surface of the card.

As described above, with this invention, even when the IC card is wrongly inserted, the connector can be protected against being subjected to an excess force from the IC card, thus preventing possible deformation or break and maintaining reliability of the connector.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A card connector having a connector body for removably holding an IC card from a predetermined insertion inlet to a correct insertion position, the IC card having a front surface flat in shape, a back surface having stepped portions formed by a raised surface portion, and recessed surface portions formed at least on both side portions of the raised surface portion, the card connector having electric contacts for making electrical contact with electric contacts of the IC card when inserted to reach the correct insertion position in the connector body, the connector body comprising:

side portions having guiding surfaces to guide side surfaces of the inserted IC card;

a bottom portion having a support surface to support the recessed surface portions formed on both side portions of the back surface or to support the front surface of the inserted IC card, the bottom portion further having stepped portions configured to engage the raised surface portion formed on the back surface of the IC card and permit the IC card to move with respect to an IC card insertion/retraction direction when the back surface of the IC card is supported on the support surface; and a top plate portion disposed opposite the support surface of the bottom portion to keep the inserted IC card from floating upward;

wherein the top plate portion has:

a restriction surface being disposed opposite each of the recessed surface portions formed on both side portions of the back surface of the IC card to keep the IC card from floating upward when the IC card is inserted into the connector body with the front surface of the IC card being supported on the support surface, or the restriction surface being disposed opposite the front surface of the IC card to keep the IC card from floating upward when the IC card is inserted into the connector body with the recessed surface portions formed on both side portions of the back surface of the IC card being supported on the support surface; and a receiving groove sized to accommodate and prevent the raised surface portion from abutting the top plate portion when the IC card is inserted into the connector body with the front surface of the IC card being supported on the support surface.

2. A card connector according to claim 1, wherein a body of the IC card has a front portion that is formed laterally asymmetric with respect to the insertion direction by forming a notch portion at one part of the card body, wherein the connector body has an abutment portion and a protruding portion, the abutment portion engaging a front end face of the IC card and the protruding portion engaging the notch portion when the IC card is inserted with the recessed surface portions formed in the back surface of the IC card being supported on the support surface and reaches the correct insertion position, and wherein when the IC card is inserted with the front surface of the IC card being supported on the support surface, the protruding portion engages the front portion of the IC card to block the insertion of the IC card at a position short of the correct insertion position with respect to the insertion direction.

3. A card connector according to claim 2, wherein the receiving groove is formed to extend from behind a blocking position, with respect to the IC card insertion direction, to a rear end of the top plate portion, the blocking position being a position where the front portion of the IC card engages the protruding portion when the IC card is inserted with the front surface of the IC card supported on the support surface.

4. A card connector according to claim 1, wherein the raised surface portion of the IC card is rectangular in shape and has side surfaces situated inwardly of side surfaces of the front surface of a card body, the receiving groove is formed by a recessed groove extending inwardly from a rear end of the top plate portion with respect to the IC card insertion direction and spanning slightly wider than the raised surface portion, and the top plate portion is U-shaped when viewed from above.

5. A card connector according to claim 2, wherein the raised surface portion of the IC card is rectangular in shape and has side surfaces situated inwardly of side surfaces of the front surface of the card body, the receiving groove is formed by a recessed groove extending inwardly from a rear end of the top plate portion with respect to the IC card insertion direction and spanning slightly wider than the raised surface portion, and the top plate portion is U-shaped when viewed from above.

6. A card connector according to claim 3, wherein the raised surface portion of the IC card is rectangular in shape and has side surfaces situated inwardly of side surfaces of the front surface of the card body, the receiving groove is formed by a recessed groove extending inwardly from a rear end of the top plate portion with respect to the IC card insertion direction and spanning slightly wider than the raised surface portion, and the top plate portion is U-shaped when viewed from above.

7. A card connector according to claim 1, wherein the receiving groove is formed by a recessed surface portion which is recessed from the restriction surface of the top plate portion.

8. A card connector according to claim 2, wherein the receiving groove is formed by a recessed surface portion which is recessed from the restriction surface of the top plate portion.

9. A card connector according to claim 3, wherein the receiving groove is formed by a recessed surface portion which is recessed from the restriction surface of the top plate portion.

10. A card connector according to claim 4, wherein the top plate portion is formed with at least one bulging portion bulging rearwardly with respect to the IC card insertion direction and being spaced from both of the side portions.

11. A card connector according to claim 1, wherein the receiving groove is dimensioned such that a dimension in a direction orthogonal to the IC card insertion direction is set at a value larger than the raised surface portion, and such that a front end of the receiving groove in the IC card insertion direction is set to be positioned forwardly of a front end of the raised surface portion of the IC card when the IC card is inserted to reach the correct insertion position.

12. A card connector having a connector body for removably holding an IC card from a predetermined insertion inlet to a correct insertion position, the IC card having a card body having a front portion formed laterally asymmetrically with a notch portion at one part of the card body, a front surface flat in shape, a back surface having stepped portions formed by a raised surface portion, and recessed surface portions formed at least on both side portions of the raised surface portion, the card connector having electric contacts for making electrical contact with electric contacts of the IC card when inserted to reach the correct insertion position in the connector body, the connector body comprising:

side portions having guiding surfaces to guide side surfaces of the inserted IC card;

a bottom portion having a support surface to support the recessed surface portions formed on both side portions of the back surface or to support the front surface of the inserted IC card, the bottom portion further having stepped portions configured to engage the raised surface portion formed on the back surface of the IC card and permit the IC card to move with respect to an IC card insertion/retraction direction when the back surface of the IC card is supported on the support surface;

an abutment portion and a protruding portion, the abutment portion engaging a front end face of the IC card and the protruding portion engaging the notch portion when the IC card is inserted with the recessed surface portions formed in the back surface of the IC card being supported on the support surface and reaches the correct insertion position, the protruding portion engaging the front portion of the IC card to block the insertion of the IC card at a blocking position short of the correct insertion position with respect to the insertion direction when the IC card is inserted with the front surface of the IC card being supported on the support surface; and a top plate portion disposed opposite the support surface of the bottom portion to keep the inserted IC card from floating upward;

wherein the top plate portion has:

a restriction surface being disposed opposite each of the recessed surface portions formed on both side portions of the back surface of the IC card to keep the IC card from floating upward when the IC card is inserted into the connector body with the front surface of the IC card being supported on the support surface, or the restriction surface being disposed opposite the front surface of the IC card to keep the IC card from floating upward when the IC card is inserted into the connector body with the recessed surface portions formed on both side portions of the back surface of the IC card being supported on the support surface; and the receiving groove extending, with respect to the IC card insertion direction, from behind the blocking position to a rear end of the top plate portion such that the rear end of the top plate portion is positioned between the blocking position and the abutment portion.

* * * * *